US009139951B2

(12) United States Patent
Bellinger et al.

(10) Patent No.: US 9,139,951 B2
(45) Date of Patent: Sep. 22, 2015

(54) LAUNDRY TREATING APPLIANCE AND METHOD OF CONTROLLING THE HEATER THEREOF

(75) Inventors: Ryan R. Bellinger, Saint Joseph, MI (US); Brian A. Black, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 503 days.

(21) Appl. No.: 13/567,285

(22) Filed: Aug. 6, 2012

(65) Prior Publication Data

US 2014/0033559 A1 Feb. 6, 2014

(51) Int. Cl.

| | |
|---|---|
| ***H05B 1/02*** | (2006.01) |
| ***D06F 58/28*** | (2006.01) |
| ***D06F 58/26*** | (2006.01) |

(52) U.S. Cl.

CPC ..... *D06F 58/28* (2013.01); *D06F 58/26* (2013.01); *D06F 2058/289* (2013.01)

(58) Field of Classification Search

CPC ..... D06F 58/02; D06F 58/10; D06F 58/04; D06F 58/28; D06F 2058/2841; D06F 2058/2829; D06F 2058/2806; D06F 2058/289; F26B 3/34; H05B 1/0272; H05B 1/0202; H05B 2203/005; H05B 2203/036

USPC ..... 219/483, 484, 486, 494, 505, 508–510, 219/211; 34/485, 493

See application file for complete search history.

(56) References Cited

U.S. PATENT DOCUMENTS

| | | | | |
|---|---|---|---|---|
| 3,571,941 | A * | 3/1971 | Garfield et al. | 34/527 |
| 3,942,265 | A * | 3/1976 | Sisler et al. | 34/527 |
| 3,944,841 | A | 3/1976 | Janke | |
| 4,083,118 | A * | 4/1978 | Cotton | 34/562 |
| 5,245,764 | A | 9/1993 | Sung | |
| 5,443,541 | A * | 8/1995 | St. Louis | 34/486 |
| 6,111,231 | A * | 8/2000 | Corson et al. | 219/506 |
| 6,822,201 | B2 | 11/2004 | Park | |
| 6,924,466 | B2 * | 8/2005 | Lee | 219/483 |
| 8,042,284 | B2 | 10/2011 | Yoo et al. | |
| 8,196,441 | B2 | 6/2012 | Hendrickson et al. | |
| 8,344,292 | B2 * | 1/2013 | Franca et al. | 219/480 |
| 8,637,795 | B2 * | 1/2014 | Giri et al. | 219/490 |
| 2003/0217480 | A1 * | 11/2003 | Bruntz et al. | 34/543 |
| 2009/0133283 | A1 | 5/2009 | Ricklefs et al. | |
| 2010/0179705 | A1 * | 7/2010 | Flohr | 700/295 |

FOREIGN PATENT DOCUMENTS

| | | | |
|---|---|---|---|
| EP | 0362676 | B1 | 4/1994 |
| EP | 0452678 | B1 | 11/1995 |
| GB | 2283083 | A | 4/1995 |

* cited by examiner

*Primary Examiner* — Mark Paschall

(57) ABSTRACT

A method of operating a household appliance to vary the thermal output of the electric heater by selectively coupling heating elements between power supply mains.

24 Claims, 3 Drawing Sheets

LAUNDRY TREATING APPLIANCE AND METHOD OF CONTROLLING THE HEATER THEREOF

BACKGROUND OF THE INVENTION

Laundry treating appliances, such as laundry dryers, may be provided with a treating chamber in which laundry items are placed for treatment according to a cycle of operation. For some laundry treating appliances, the laundry items may be treated by air flow to remove liquid from the laundry items. The air flow may be heated by a heating element, which has been traditionally operated at full power when ON. Therefore, to maintain a desired temperature, the heating element is normally cycled between ON/OFF states according to a duty cycle that will provide the desired temperature.

SUMMARY

A method of operating a household appliance having a treating chamber for receiving one or more items for treatment according to a cycle of operation requiring a heating phase and an electric heater with at least first and second heating elements. Supplied electricity from a power supply having three mains, a first main, a second main, and a neutral main, comprises varying a total thermal output of the electric heater during the heating phase by selectively coupling the first heating element between the first main and second mains to provide a first thermal output from the first heating element and selectively coupling the second heating element between the neutral main and the second main to provide a second thermal output, and between the first main and the second main to provide a third thermal output, whereby the selectively coupling of the first and second heating elements provides for varying the total thermal output of the heater between any one of at least five possible thermal outputs comprising any one of the first thermal output, second thermal output, third thermal output, and combinations of the first thermal output with either the second and third thermal outputs.

DESCRIPTION OF EMBODIMENTS OF THE INVENTION

Figure 1:
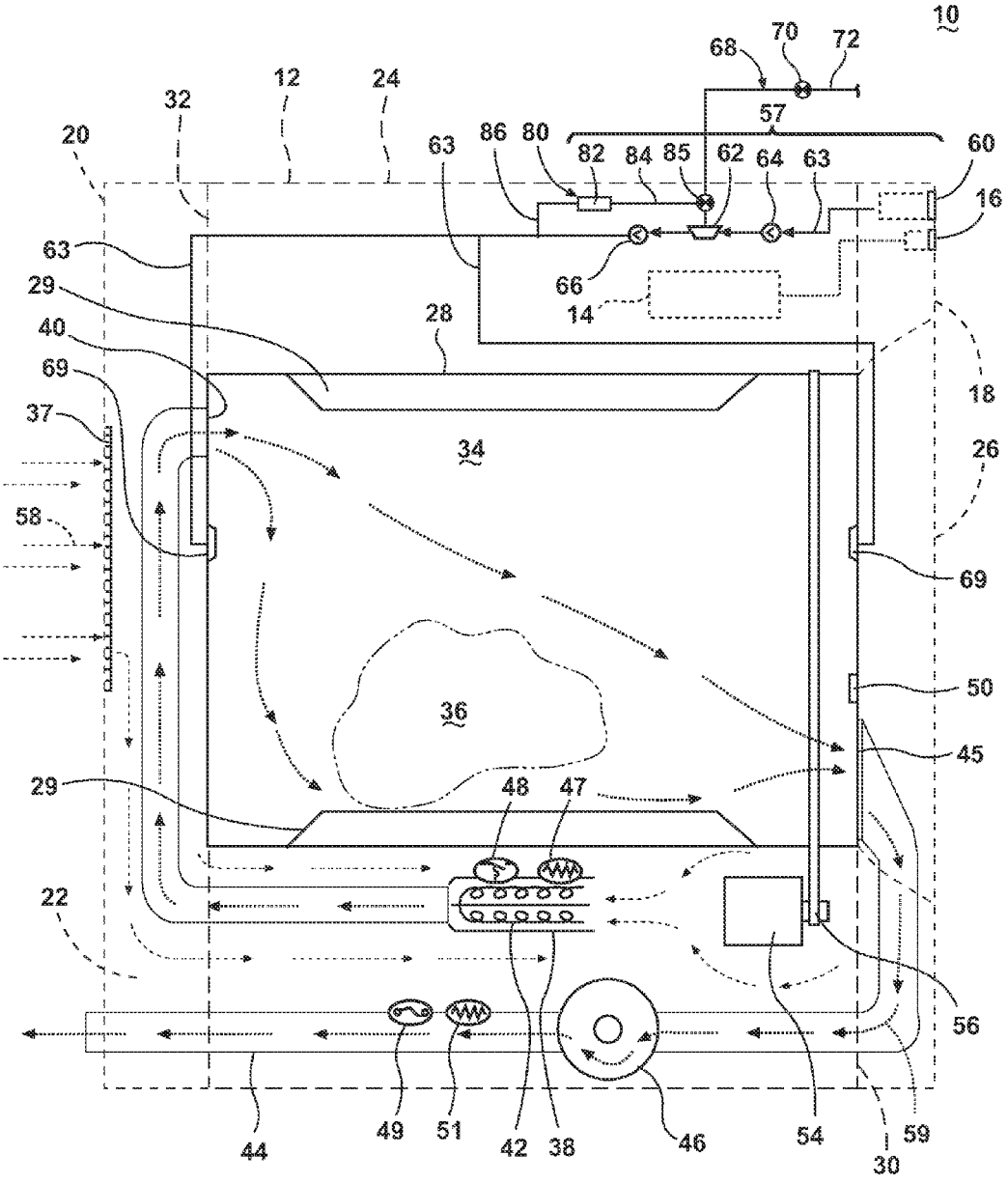
FIG. 1 is a schematic view of a laundry treating appliance in the form of a clothes dryer according to a first embodiment of the invention.

FIG. 1 is a schematic view of a laundry treating appliance 10 in the form of a clothes dryer 10 that may be controlled according to one embodiment of the invention. The clothes dryer 10 described herein shares many features of a traditional automatic clothes dryer, which will not be described in detail except as necessary for a complete understanding of the invention. While the embodiments of the invention are described in the context of a clothes dryer 10, the embodiments of the invention may be used with any type of laundry treating appliance, non-limiting examples of which include a washing machine, a combination washing machine and dryer and a refreshing/revitalizing machine.

As illustrated in FIG. 1, the clothes dryer 10 may include a cabinet 12 in which is provided a controller 14 that may receive input from a user through a user interface 16 for selecting a cycle of operation and controlling the operation of the clothes dryer 10 to implement the selected cycle of operation.

The cabinet 12 may be defined by a front wall 18, a rear wall 20, and a pair of side walls 22 supporting a top wall 24. A chassis may be provided with the walls being panels mounted to the chassis. A door 26 may be hingedly mounted to the front wall 18 and may be selectively movable between opened and closed positions to close an opening in the front wall 18, which provides access to the interior of the cabinet 12.

A rotatable drum 28 may be disposed within the interior of the cabinet 12 between opposing stationary front and rear bulkheads 30, 32, which, along with the door 26, collectively define a treating chamber 34 for treating laundry. As illustrated, and as is the case with most clothes dryers, the treating chamber 34 is not fluidly coupled to a drain. Thus, any liquid introduced into the treating chamber 34 may not be removed merely by draining.

Non-limiting examples of laundry that may be treated according to a cycle of operation include, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be treated in the clothes dryer 10.

The drum 28 may include at least one lifter 29. In most dryers, there may be multiple lifters. The lifters may be located along an inner surface of the drum 28 defining an interior circumference of the drum 28. The lifters may facilitate movement of the laundry 36 within the drum 28 as the drum 28 rotates.

The drum 28 may be operably coupled with a motor 54 to selectively rotate the drum 28 during a cycle of operation. The coupling of the motor 54 to the drum 28 may be direct or indirect. As illustrated, an indirect coupling may include a belt 56 coupling an output shaft of the motor 54 to a wheel/pulley on the drum 28. A direct coupling may include the output shaft of the motor 54 coupled to a hub of the drum 28.

An air system may be provided to the clothes dryer 10. The air system supplies air to the treating chamber 34 and exhausts air from the treating chamber 34. The supplied air may be heated or not. The air system may have an air supply portion that may form, in part, a supply conduit 38, which has one end open to ambient air via a rear vent 37 and another end fluidly coupled to an inlet grill 40, which may be in fluid communication with the treating chamber 34. An electric heater 42 may lie within the supply conduit 38 and may be operably coupled to and controlled by the controller 14. If the electric heater 42 is turned on, the supplied air will be heated prior to entering the drum 28.

The air system may further include an air exhaust portion that may be formed in part by an exhaust conduit 44. A lint trap 45 may be provided as the inlet from the treating chamber 34 to the exhaust conduit 44. A blower 46 may be fluidly coupled to the exhaust conduit 44. The blower 46 may be operably coupled to and controlled by the controller 14. Operation of the blower 46 draws air into the treating chamber 34 as well as exhausts air from the treating chamber 34 through the exhaust conduit 44. The exhaust conduit 44 may be fluidly coupled with a household exhaust duct (not shown)

for exhausting the air from the treating chamber 34 to the outside of the clothes dryer 10.

The air system may further include various sensors and other components, such as a thermistor 47 and a thermostat 48, which may be coupled to the supply conduit 38 in which the electric heater 42 may be positioned. The thermistor 47 and the thermostat 48 may be operably coupled to each other. Alternatively, the thermistor 47 may be coupled to the supply conduit 38 at or near to the inlet grill 40. Regardless of its location, the thermistor 47 may be used to aid in determining an inlet temperature. A thermistor 51 and a thermal fuse 49 may be coupled to the exhaust conduit 44, with the thermistor 51 being used to determine an outlet air temperature.

A moisture sensor 50 may be positioned in the interior of the treating chamber 34 to monitor the amount of moisture of the laundry in the treating chamber 34. One example of a moisture sensor 50 is a conductivity strip. The moisture sensor 50 may be operably coupled to the controller 14 such that the controller 14 receives output from the moisture sensor 50. The moisture sensor 50 may be mounted at any location in the interior of the dispensing dryer 10 such that the moisture sensor 50 may be able to accurately sense the moisture content of the laundry. For example, the moisture sensor 50 may be coupled to one of the bulkheads 30, 32 of the drying chamber 34 by any suitable means.

A dispensing system 57 may be provided to the clothes dryer 10 to dispense one or more treating chemistries to the treating chamber 34 according to a cycle of operation. As illustrated, the dispensing system 57 may be located in the interior of the cabinet 12 although other locations are also possible. The dispensing system 57 may be fluidly coupled to a water supply 68. The dispensing system 57 may be further coupled to the treating chamber 34 through one or more nozzles 69. As illustrated, nozzles 69 are provided to the front and rear of the treating chamber 34 to provide the treating chemistry or liquid to the interior of the treating chamber 34, although other configurations are also possible. The number, type and placement of the nozzles 69 are not germane to the invention.

As illustrated, the dispensing system 57 may include a reservoir 60, which may be a cartridge, for a treating chemistry that is releasably coupled to the dispensing system 57, which dispenses the treating chemistry from the reservoir 60 to the treating chamber 34. The reservoir 60 may include one or more cartridges configured to store one or more treating chemistries in the interior of cartridges. A suitable cartridge system may be found in U.S. Pat. No. 8,196,441 to Hendrickson et al., issued Jun. 12, 2012, entitled "Household Cleaning Appliance with a Dispensing System Operable Between a Single Use Dispensing System and a Bulk Dispensing System," which is herein incorporated by reference in its entirety.

A mixing chamber 62 may be provided to couple the reservoir 60 to the treating chamber 34 through a supply conduit 63. Pumps such as a metering pump 64 and delivery pump 66 may be provided to the dispensing system 57 to selectively supply a treating chemistry and/or liquid to the treating chamber 34 according to a cycle of operation. The water supply 68 may be fluidly coupled to the mixing chamber 62 to provide water from the water source to the mixing chamber 62. The water supply 68 may include an inlet valve 70 and a water supply conduit 72. It is noted that, instead of water, a different treating chemistry may be provided from the exterior of the clothes dryer 10 to the mixing chamber 62.

The treating chemistry may be any type of aid for treating laundry, non-limiting examples of which include, but are not limited to, water, fabric softeners, sanitizing agents, de-wrinkling or anti-wrinkling agents, and chemicals for imparting desired properties to the laundry, including stain resistance, fragrance (e.g., perfumes), insect repellency, and UV protection.

The dryer 10 may also be provided with a steam generating system 80 which may be separate from the dispensing system 57 or integrated with portions of the dispensing system 57 for dispensing steam and/or liquid to the treating chamber 34 according to a cycle of operation. The steam generating system 80 may include a steam generator 82 fluidly coupled with the water supply 68 through a steam inlet conduit 84. A fluid control valve 85 may be used to control the flow of water from the water supply conduit 72 between the steam generating system 80 and the dispensing system 57. The steam generator 82 may further be fluidly coupled with the one or more supply conduits 63 through a steam supply conduit 86 to deliver steam to the treating chamber 34 through the nozzles 69. Alternatively, the steam generator 82 may be coupled with the treating chamber 34 through one or more conduits and nozzles independently of the dispensing system 57.

The steam generator 82 may be any type of device that converts the supplied liquid to steam. For example, the steam generator 82 may be a tank-type steam generator that stores a volume of liquid and heats the volume of liquid to convert the liquid to steam. Alternatively, the steam generator 82 may be an in-line steam generator that converts the liquid to steam as the liquid flows through the steam generator 82.

It will be understood that the details of the dispensing system 57 and steam generating system 80 are not germane to the embodiments of the invention and that any suitable dispensing system and/or steam generating system may be used with the dryer 10. It is also within the scope of the invention for the dryer 10 to not include a dispensing system or a steam generating system.

Figure 2:
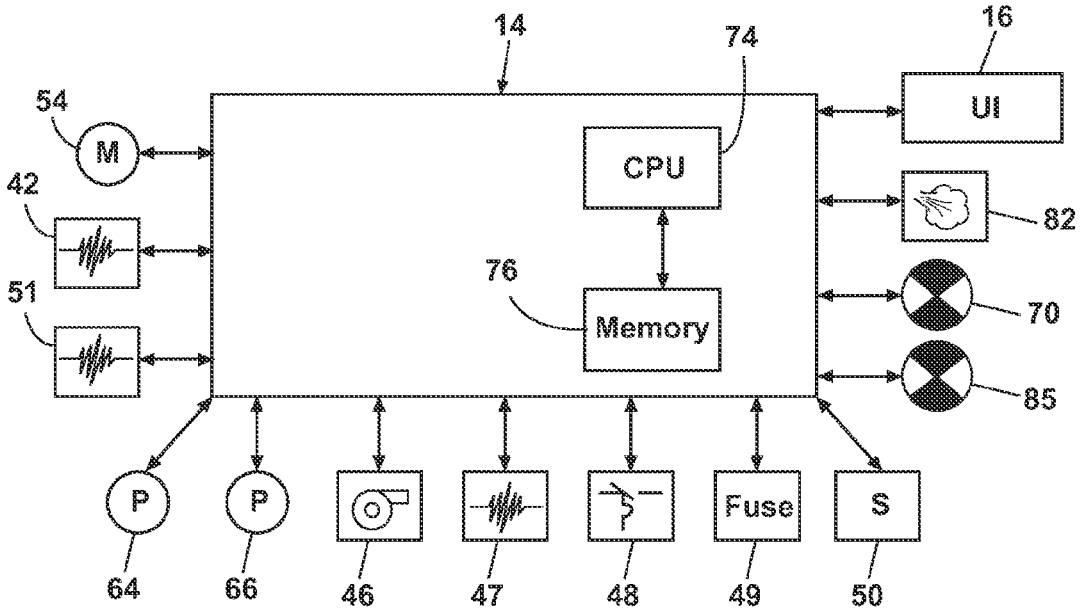
FIG. 2 is a schematic view of a controller of the clothes dryer in FIG. 1.

FIG. 2 is a schematic view of the controller 14 coupled to the various components of the dryer 10. The controller 14 may be communicably coupled to components of the clothes dryer 10 such as the electric heater 42, blower 46, thermistor 47, thermostat 48, thermal fuse 49, thermistor 51, moisture sensor 50, motor 54, inlet valve 70, pumps 64, 66, steam generator 82 and fluid control valve 85 to either control these components and/or receive their input for use in controlling the components. The controller 14 is also operably coupled to the user interface 16 to receive input from the user through the user interface 16 for the implementation of the drying cycle and provide the user with information regarding the drying cycle.

The user interface 16 may be provided having operational controls such as dials, lights, knobs, levers, buttons, switches, and displays enabling the user to input commands to a controller 14 and receive information about a treatment cycle from components in the clothes dryer 10 or via input by the user through the user interface 16. The user may enter many different types of information, including, without limitation, cycle selection and cycle parameters, such as cycle options. Any suitable cycle may be used. Non-limiting examples include, Casual, Delicate, Super Delicate, Heavy Duty, Normal Dry, Damp Dry, Sanitize, Quick Dry, Timed Dry, and Jeans.

The controller 14 may implement a treatment cycle selected by the user according to any options selected by the user and provide related information to the user. The controller 14 may also comprise a central processing unit (CPU) 74 and an associated memory 76 where various treatment cycles and associated data, such as look-up tables, may be stored. One or more software applications, such as an arrangement of executable commands/instructions may be stored in the memory and executed by the CPU 74 to implement the one or more treatment cycles.

In general, the controller 14 will effect a cycle of operation to effect a treating of the laundry in the treating chamber 34, which may or may not include drying. The controller 14 may actuate the blower 46 to draw an inlet air flow 58 into the supply conduit 38 through the rear vent 37 when air flow is needed for a selected treating cycle. The controller 14 may activate the electric heater 42 to heat the inlet air flow 58 as it passes over the electric heater 42, with the heated air 59 being supplied to the treating chamber 34. The heated air 59 may be in contact with a laundry load 36 as it passes through the treating chamber 34 on its way to the exhaust conduit 44 to effect a moisture removal of the laundry. The heated air 59 may exit the treating chamber 34, and flow through the blower 46 and the exhaust conduit 44 to the outside of the clothes dryer 10. The controller 14 continues the cycle of operation until completed. If the cycle of operation includes drying, the controller 14 determines when the laundry is dry. The determination of a "dry" load may be made in different ways, but is often based on the moisture content of the laundry, which is typically set by the user based on the selected cycle, an option to the selected cycle, or a user-defined preference.

Figure 3:
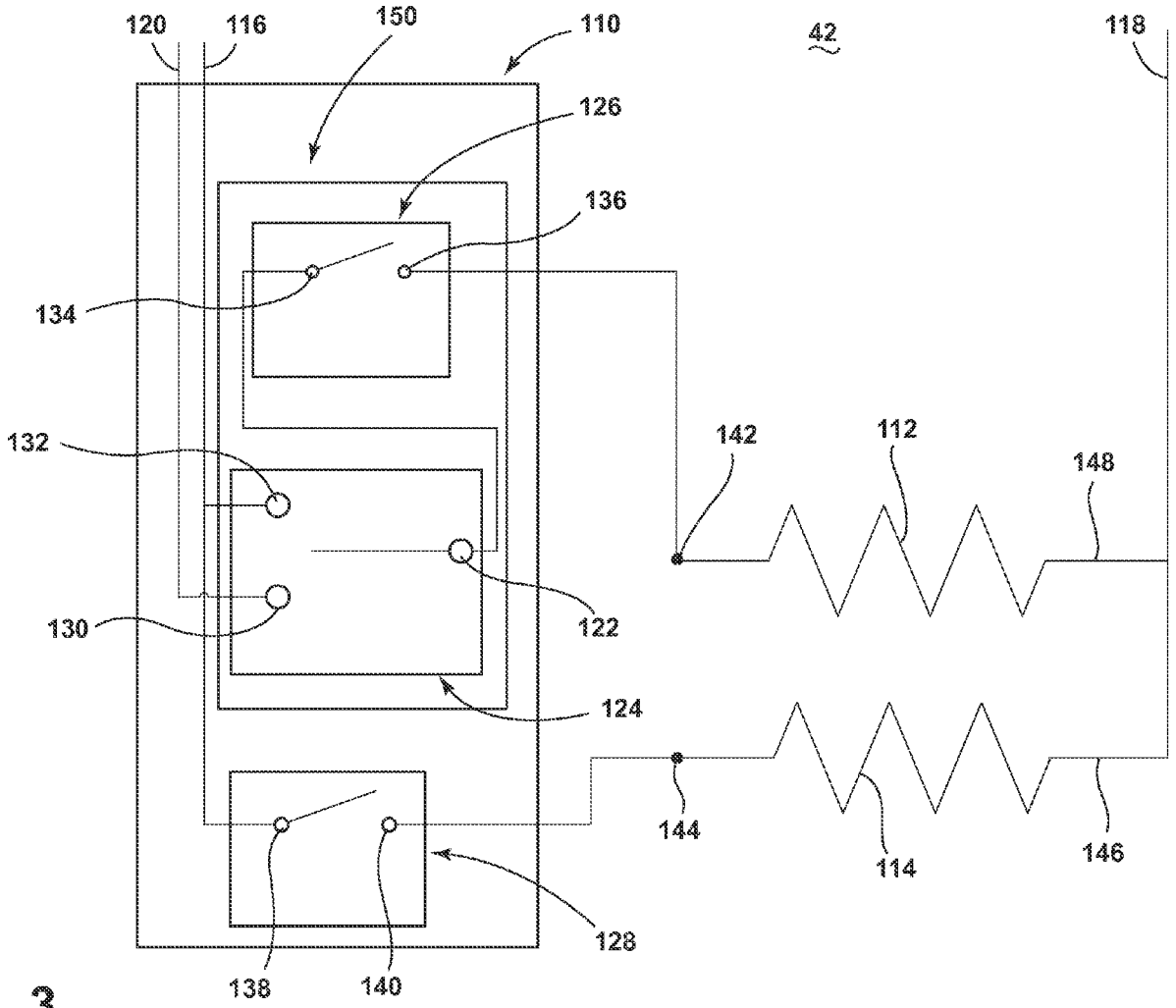
FIG. 3 is a schematic view of an electric heater for the clothes dryer in FIG. 1 for selecting multiple thermal outputs according to a first embodiment of the invention.

FIG. 3 illustrates an example of the electric heater 42, which may have multiple heating elements 112, 114 that are selectively coupled to multiple couplings or mains 116, 118, 120 of a power supply by a power switching circuit 110.

The power supply is a source of electric power for the electric heater 42 with multiple mains 116, 118, 120. One example of a possible power supply is one that provides alternating-current electric power with multiple mains known as mains power. The mains power may have a first main 116, a second main 118 and a neutral main 120. One implementation of mains power is 3-wire, single-phase where the first main 116 is L1, the second main 118 is L2, and the neutral main 120 is N. Other implementations of the power supply may be three-phase alternating-current or direct-current.

The electric heater 42, as illustrated in FIG. 3, has two heating elements 112, 114. The heating elements 112, 114 provide the thermal output for the heater 42, which provide the heater 42 with variable thermal output depending on the energized state of the heating elements 112, 114. The heating elements may provide the same or different thermal output. As illustrated, the two heating elements 112, 114 may be configured such that the first heating element 112 can deliver 70% of the maximum thermal output of the electric heater and the second heating element 114 can deliver 30% of the maximum thermal output the electric heater. However, other percentages may be chosen as needed for a desired application. Similarly, more than two heating elements may also be used.

The power switching circuit 110 selectively couples power sources to electrical loads. The power sources are coupled to the inputs of the power switching circuit 110. The electrical loads are coupled to the outputs of the power switching circuit. In the implementation of FIG. 3, the power switching circuit 110 selectively couples the heating elements 112, 114 to the mains 116, 118, 120. The power switching circuit 110 may have multiple switching subcircuits 128, 150. A switching subcircuit 128 may be a single switching element. A switching subcircuit 150 may consist of multiple switching elements 124, 126 coupled in series. As illustrated, the switching elements are relays. However, the power switching elements may be any suitable switching element such as relays, triacs, thyristors, or silicon-controlled rectifiers.

As illustrated in FIG. 3, both the first main 116 and the neutral main 120 are directly connected to a switching element 124 of a switching subcircuit 150 that is configured to switch between two positions. When switched to a first position, the switching element 124 directly connects the neutral main 120 to the switching element's output 122. When switched to a second position, the switching element 124 directly connects the first main 116 to the switching element's output 122.

The output 122 of the switching element 124 is connected to the input 134 of a switching element 126. When the switching element 126 is switched to the close position, the source of power selected from the switching element 124 is connected to the output 136 of the switching element 126. When the switching element is switched open, the output 136 of the switching element 126 is neither connected to the neutral main 120 nor the first main 116 because there is no electrical connection between the input 134 and output 136 of the switching element 126. The output 136 of the switching element 126 is directly connected to one side 142 of a first heating element 112. The second main 118 is directly connected to the other side 148 of the first heating element 112.

The first main 116 is directly connected to a switching element 128 in the power switching circuit 110. When the switching element 128 is switched to the close position, the first main 116 is connected to the output 140 of the switching element 128. When the third relay 128 is switched open, the output 140 of the switching element 128 is not connected to the first main 116. The output 140 of the switching element 128 is directly connected to one side 144 of a second heating element 114. The second main 118 is directly connected to the other side 146 of the second heating element 146.

All of the switching elements of the power switching circuit 110 described in FIG. 3 are used to select the voltage on one side of the heating elements 112, 114. The voltage on the other side of the heating elements 112, 114 is always given by the second main. The voltage drop across a heating element 112, 114 is the difference between the voltage on one side of the heating element and the other side of the heating element. Each heating element produces a thermal output in response to a given voltage drop across the element. The thermal output is proportional to the square of the voltage drop across the element. By selectively coupling the first heating element 114 between the first main 116 and second main 118 to provide a first thermal output from the first heating element 114 and selectively coupling the second heating element 112 between the neutral main 120 and the second main 118 to provide a second thermal output, and between the first main 116 and the second main 118 to provide a third thermal output, the selective coupling of the first and second heating elements 112, 114 provides for varying the total thermal output of the electric heater 42 between any one of at least five possible thermal outputs.

The power of the thermal output of each heating element is also inversely proportional to the electrical resistance of the heating element. By selecting heating elements with different resistance characteristics and controlling the voltage across each heating element independently, the electric heater 42 is capable of varying the total thermal output during the heating phase. The heating elements 112, 114 may be selected to enable a discrete set of thermal outputs with approximately evenly stepped increases in thermal outputs where none of the thermal outputs are the same.

For example, in a particular embodiment of the invention, the electric heater is connected to a 3-wire, two phase system where the first main L1, and the second main, L2, are 120V each and 180 degrees out-of-phase. The voltage drop from L1 to L2 is 240V and is typically noted by referring to the voltage at L2 as −120V. The resistance of the first heating element is 15 Ohms and the second heating element is 35.5 Ohms which will enable the third thermal output to be greater than 2.3 times the first thermal output. The configuration is chosen to produce five non-zero thermal outputs: 17.5, 30, 47.5, 70 and 100% of the fully available thermal output which is 5400 W. The selectable thermal outputs of this configuration are beneficial because they approximate a smoothly varying set of thermal outputs ranging from zero to full power.

In another embodiment of the invention, the power switching circuit is configured to selectively couple the first main 116 or the neutral main 120 across either of the heating elements instead of just the first heating element. This embodiment would have additional selectable thermal outputs other than the five non-zero thermal outputs of the previous embodiment. The particular thermal outputs can be controlled by selecting particular heating elements. Other embodiments may have heating elements that are substantially different than the 15 Ohm and 35.5 Ohm heating elements in the previous embodiment. The ratio between the electrical resistances of the two heating elements can be substantially altered to change the spacing between the selectable thermal outputs. The values of the electrical resistance of the two heating elements can be substantially altered to change the available thermal output from the heater from the 5400 W shown in the previous embodiment.

The benefit of this invention is that the plurality of thermal outputs allows for tight control of the operating temperature of heat delivered as exhaust to the laundry load during a laundry drying cycle of operation. The electric heater can be controlled to deliver a thermal output based on the size of the laundry load. Typically, the electric heater is continuously run at full power until the temperature of the laundry load reaches a threshold. Then, the electric heater will be alternately energized in a duty-cycle to maintain the temperature of the laundry load. By utilizing a set of spaced thermal outputs, the power used to maintain the laundry load temperature can be minimized. Additionally, more low power options are available for small laundry loads to maintain temperature and to achieve energy savings.

While the invention has been specifically described in connection with certain specific embodiments thereof, it is to be understood that this is by way of illustration and not of limitation, and the scope of the appended claims should be construed as broadly as the prior art will permit. It should also be noted that all elements of all of the claims may be combined with each other in any possible combination, even if the combinations have not been expressly claimed.

What is claimed is:

1. A method of operating a household appliance having a treating chamber for receiving one or more items for treatment according to a cycle of operation requiring a heating phase and an electric heater with at least first and second heating elements supplied electricity from a power supply having three mains: a first main, a second main, and a neutral main, the method comprising:

varying a total thermal output of the electric heater during the heating phase by:

selectively coupling the first heating element between the first main and second mains to provide a first thermal output from the first heating element, and selectively coupling the second heating element between the neutral main and the second main to provide a second thermal output, different than the first thermal output, and between the first main and the second main to provide a third thermal output, different than the first and the second thermal outputs;

wherein the selectively coupling of the first and second heating elements provides for varying the total thermal output of the heater between any one of at least five possible thermal outputs comprising any one of the first thermal output, second thermal output, third thermal output, and combinations of the first thermal output with either the second and third thermal outputs.

2. The method of claim 1 wherein the percent of the five thermal outputs relative to the total thermal output of the electric heater are 17.5%, 30%, 47.5%, 70%, and 100%.

3. The method of claim 1 wherein none of the five thermal outputs are the same.

4. The method of claim 1 wherein the third thermal output is at least twice as much as the first thermal output.

5. The method of claim 4 wherein the third thermal output is about 2.3 times the first thermal output.

6. The method of claim 1 wherein the second thermal output is greater than the first thermal output.

7. The method of claim 1 further comprising keeping the first heating element coupled between the first main and the second main while selectively coupling the second heating element between the neutral main and the second main and the first main and the second main.

8. The method of claim 1 further comprising selectively coupling the first heating element between the first main and the second main while selectively coupling the second heating element between the neutral main and the second main.

9. The method of claim 1 further comprising selectively coupling the first heating element between the first main and the second main while selectively coupling the second heating element between the first main and the second main.

10. The method of claim 1 further comprising varying the total thermal output of the electric heater according to an operating temperature requirement of the household appliance for the cycle of operation.

11. The method of claim 10 wherein the cycle of operation is a laundry drying cycle.

12. The method of claim 11 wherein the operating temperature is an exhaust temperature.

13. The method of claim 1 wherein the first main comprises one of L1 and L2 and the second main comprise the other of L1 and L2.

14. A household appliance for treating at least one item according to a cycle of operation and configured to receive power from a power source having a first main, a second main, and a neutral main, the household appliance comprising:

a treating chamber for receiving the item;

a heating system providing heat to the treating chamber and having at least a first heating element and a second heating element;

a first switch selectively coupling the first heating element between the first main and the second main to provide a first thermal output from the first heating element;

a second switch selectively coupling the second heating element between the neutral main and the second main to provide a second thermal output, different than the first thermal output, from the second heating element and the first main and the second main to provide a third thermal output, different than the first and the second thermal outputs, from the second heating element;

wherein the first and second switches may be selectively controlled to varying the thermal output of the heating between any one of at least the five thermal outputs comprising any one of the first thermal output, second thermal output, third thermal output, and combinations of the first thermal output with either the second and third thermal outputs.

15. The household appliance of claim 14 wherein the first switch comprises a first relay.

16. The household appliance of claim 15 wherein the second switch comprises second and third relays in series, with the second relay coupled to both the neutral main and the first main, and the third relay coupled to the second relay and the second heating element.

17. The household appliance of claim 16 wherein the first and second heating elements are coupled to the L2 main.

18. The household appliance of claim 14 wherein the percent of the five thermal outputs relative to the total thermal output of the electric heater are 17.5%, 30%, 47.5%, 70%, and 100%.

19. The household appliance of claim 14 wherein none of the five thermal outputs are the same.

20. The household appliance of claim 14 wherein the third thermal output is at least twice as much as the first thermal output.

21. The household appliance of claim 20 wherein the third thermal output is about 2.3 times the first thermal output.

22. The household appliance of claim 14 wherein the second thermal output is greater than the first thermal output.

23. The household appliance of claim 14 further comprising a controller operably coupled to the first and second switches to control the operation of the switches and vary the thermal output of the heating system according to the cycle of operation.

24. The household appliance of claim 23 wherein the treating chamber comprises a laundry drying chamber.

* * * * *